US010675865B2

(12) United States Patent
Tsukamoto

(10) Patent No.: US 10,675,865 B2
(45) Date of Patent: Jun. 9, 2020

(54) LIQUID DISCHARGE APPARATUS

(71) Applicant: Ryuji Tsukamoto, Kanagawa (JP)

(72) Inventor: Ryuji Tsukamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/365,872

(22) Filed: Mar. 27, 2019

(65) Prior Publication Data

US 2019/0299597 A1 Oct. 3, 2019

(30) Foreign Application Priority Data

Mar. 30, 2018 (JP) ..... 2018-066882
Mar. 20, 2019 (JP) ..... 2019-053148

(51) Int. Cl.
*B41J 2/045* (2006.01)
*B41J 2/14* (2006.01)
*B41J 2/175* (2006.01)

(52) U.S. Cl.
CPC ..... *B41J 2/04536* (2013.01); *B41J 2/04581* (2013.01); *B41J 2/1433* (2013.01); *B41J 2/17563* (2013.01)

(58) Field of Classification Search
CPC .. B41J 2/04536; B41J 2/04581; B41J 2/1433; B41J 2/17563
See application file for complete search history.

(56) References Cited

U.S. PATENT DOCUMENTS 9,694,581 B2 * 7/2017 Yoshida ..... B41J 2/14274
2015/0306875 A1 10/2015 Nishimura et al.
2016/0136955 A1 5/2016 Nishimura et al.
2016/0136962 A1 5/2016 Nishimura et al.
2017/0182777 A1 6/2017 Nishimura et al.
2017/0253034 A1 9/2017 Tsukamoto

FOREIGN PATENT DOCUMENTS

JP 10-114081 5/1998
JP 2007-185867 7/2007
JP 2011-218784 11/2011
JP 2014-151544 8/2014
WO WO2015/163487 A1 10/2015

* cited by examiner

*Primary Examiner* — Thinh H Nguyen
(74) *Attorney, Agent, or Firm* — Harness, Dickey & Pierce, P.L.C.

(57) ABSTRACT

A liquid discharge apparatus includes a liquid discharge head including a nozzle plate including at least one nozzle configured to discharge liquid; at least one individual liquid chamber respectively communicating with the at least one nozzle; at least one individual supply channel respectively communicating with the at least one individual liquid chamber; and at least one individual collecting channel respectively communicating with the at least one individual liquid chamber. The apparatus further includes circuitry configured to store, in a memory, a backflow-inducing discharge amount at which the liquid in the individual collecting channel flows in a reverse direction toward the individual liquid chamber, in response to discharge of the liquid from the nozzle; and set a discharge amount from the nozzle equal to or greater than the backflow-inducing discharge amount, to cause the liquid to flow in the reverse direction in the individual collecting channel.

2 Claims, 9 Drawing Sheets

FIG. 9

| DISCHARGE DROPLET AMOUNT (pl) | DRIVE FREQUENCY (kHz) | DISCHARGE AMOUNT (ml/min) | SUPPLY FLOW RATE (ml/min) | RECOVERY FLOW RATE (ml/min) | NUMBER OF TIMES OF DRIVE | FLOW DIRECTION |
|---|---|---|---|---|---|---|
| 2 | 5 | 0.0006 | 0.057 | 0.0015 | NO DISCHARGE | NORMAL |
| 2 | 50 | 0.006 | 0.048 | −0.0012 | 300 | REVERSE |
| 8 | 5 | 0.0024 | 0.003 | 0.0006 | NO DISCHARGE | NORMAL |
| 8 | 40 | 0.0192 | 0.0114 | −0.0078 | 200 | REVERSE |
| 20 | 5 | 0.006 | 0.0048 | −0.0012 | 3000 | REVERSE |
| 20 | 35 | 0.042 | 0.0228 | −0.0192 | 2 | REVERSE |

LIQUID DISCHARGE APPARATUS

CROSS-REFERENCE TO RELATED APPLICATIONS

This patent application is based on and claims priority pursuant to 35 U.S.C. § 119(a) to Japanese Patent Applications No. 2018-066882, filed on Mar. 30, 2018, and 2019-053148, filed on Mar. 20, 2019, in the Japan Patent Office, the entire disclosure of which is hereby incorporated by reference herein.

BACKGROUND

Technical Field

The present disclosure relates to a liquid discharge apparatus including a head to discharge liquid.

Description of the Related Art

As one type of liquid discharge head (a droplet discharge head) to discharge liquid, there are circulation-type liquid discharge heads including a plurality of individual liquid chambers (pressure chambers). In the circulation-type head, the liquid supplied to the individual liquid chambers but is not discharged therefrom is collected through an individual collecting channel, to facilitate discharge of bubbles mixed in the liquid in the individual liquid chambers and suppress changes in properties of the liquid.

For example, there are circulation-type liquid discharge heads that include an ink supply channel through which ink is supplied from an ink introduction port, an ink discharge channel for discharging the ink to an ink discharge port, an ink chamber through which the ink supply channel communicates with the ink discharge channel, and a piezoelectric actuator to displace a diaphragm of the ink chamber and apply pressure to the ink in the ink chamber. The ink chamber includes nozzles to discharge ink.

SUMMARY

An embodiment of this disclosure provides a liquid discharge apparatus that includes a liquid discharge head including a nozzle plate including at least one nozzle configured to discharge liquid; at least one individual liquid chamber communicating with the at least one nozzle, respectively; at least one individual supply channel communicating with the at least one individual liquid chamber, respectively; and at least one individual collecting channel communicating with the at least one individual liquid chamber, respectively. The liquid discharge apparatus further includes circuitry configured to store, in a memory, a backflow-inducing discharge amount and set a discharge amount from each nozzle equal to or greater than the backflow-inducing discharge amount, to cause the liquid to flow in reverse in the corresponding individual collecting channel. At the backflow-inducing discharge amount, the liquid in the individual collecting channel flows in a reverse direction toward the corresponding individual liquid chamber, in response to discharge of the liquid from the corresponding nozzle.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 9 is a table illustrating the relation between the amount per unit time of liquid discharged, the direction of liquid flow, and bubble discharge performance in the structure illustrated in FIG. 8.

Figure 1:
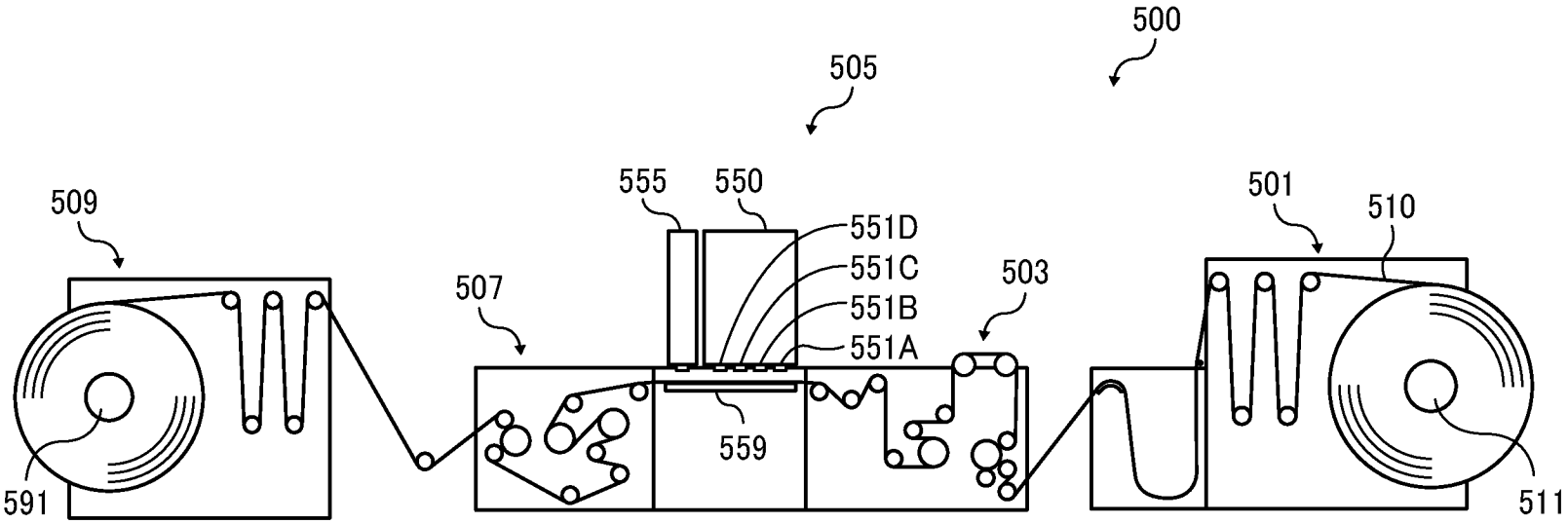
FIG. 1 is a schematic side view of a printer as a liquid discharge apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, an example printer serving as a liquid discharge apparatus according to the present embodiment is described. As used herein, the singular forms "a", "an", and "the" are intended to include the plural forms as well, unless the context clearly indicates otherwise.

Figure 2:
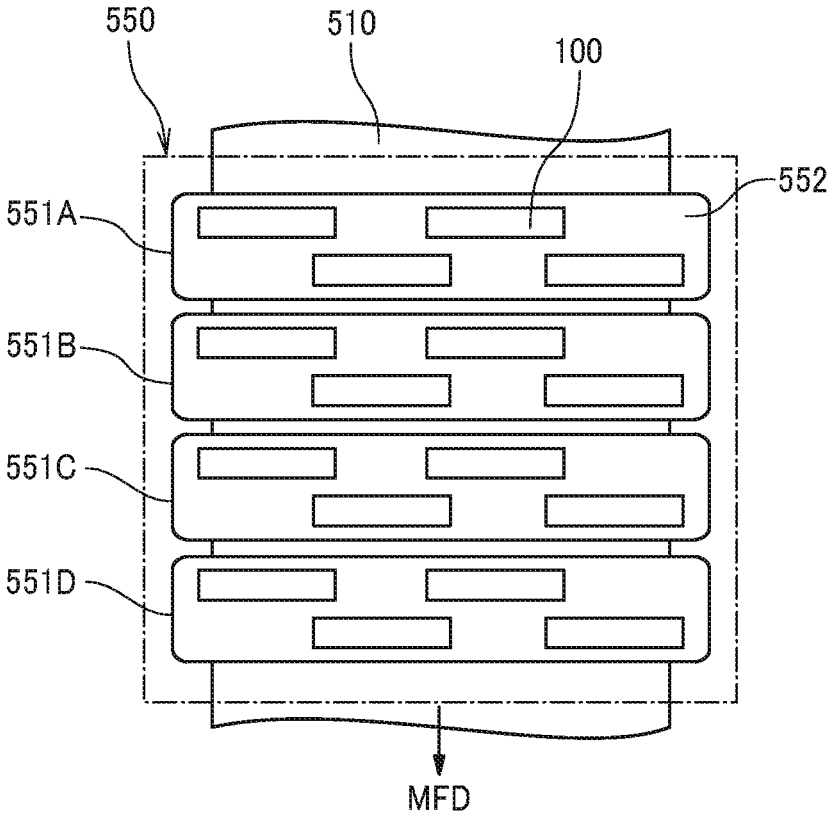
FIG. 2 is a plan view of a head unit of the printer illustrated in FIG. 1.

FIG. 1 is a schematic side view of a printer 500 according to the present embodiment. FIG. 2 is a plan view of a head unit 550 of the printer 500 illustrated in FIG. 1.

The printer 500 serving as the liquid discharge apparatus includes a feeder 501 to feed a continuous medium 510, such as a rolled sheet, a guide conveyor 503 to guide and convey the continuous medium 510 fed from the feeder 501 to a printing unit 505, the printing unit 505 to discharge liquid onto the continuous medium 510 to form an image on the continuous medium 510, a drier unit 507 to dry the continuous medium 510, and an ejection unit 509 to discharge the continuous medium 510.

The continuous medium 510 is fed from a root winding roller 511 of the feeder 501, guided and conveyed with rollers of the feeder 501, the guide conveyor 503, the drier unit 507, and the ejection unit 509, and wound around a winding roller 591 of the ejection unit 509.

In the printing unit 505, the continuous medium 510 is conveyed on a conveyance guide 559, opposite head units 550 and 555. The head unit 550 discharges liquid to form an image on the continuous medium 510. Post-treatment is performed on the continuous medium 510 with treatment liquid discharged from the head unit 555.

The head unit 550 includes, for example, four-color full-line head arrays 551A, 551B, 551C, and 551D (hereinafter, collectively referred to as "head arrays 551" unless colors are distinguished) from an upstream side in the direction of conveyance of the medium 510 (hereinafter, "medium conveyance direction") indicated by arrow MFD in FIG. 2.

The head arrays 551 are liquid dischargers to discharge liquid of black (K), cyan (C), magenta (M), and yellow (Y) onto the continuous medium 510. Note that the number and types of colors are not limited to the above-described four colors of K, C, M, and Y and may be any other suitable number and types.

Each head array 551 includes, for example, liquid discharge heads 100 (see FIG. 3, may be simply "heads 100") staggered on a base 552. Note that the configuration of the head array 551 is not limited to such a configuration.

Figure 3:
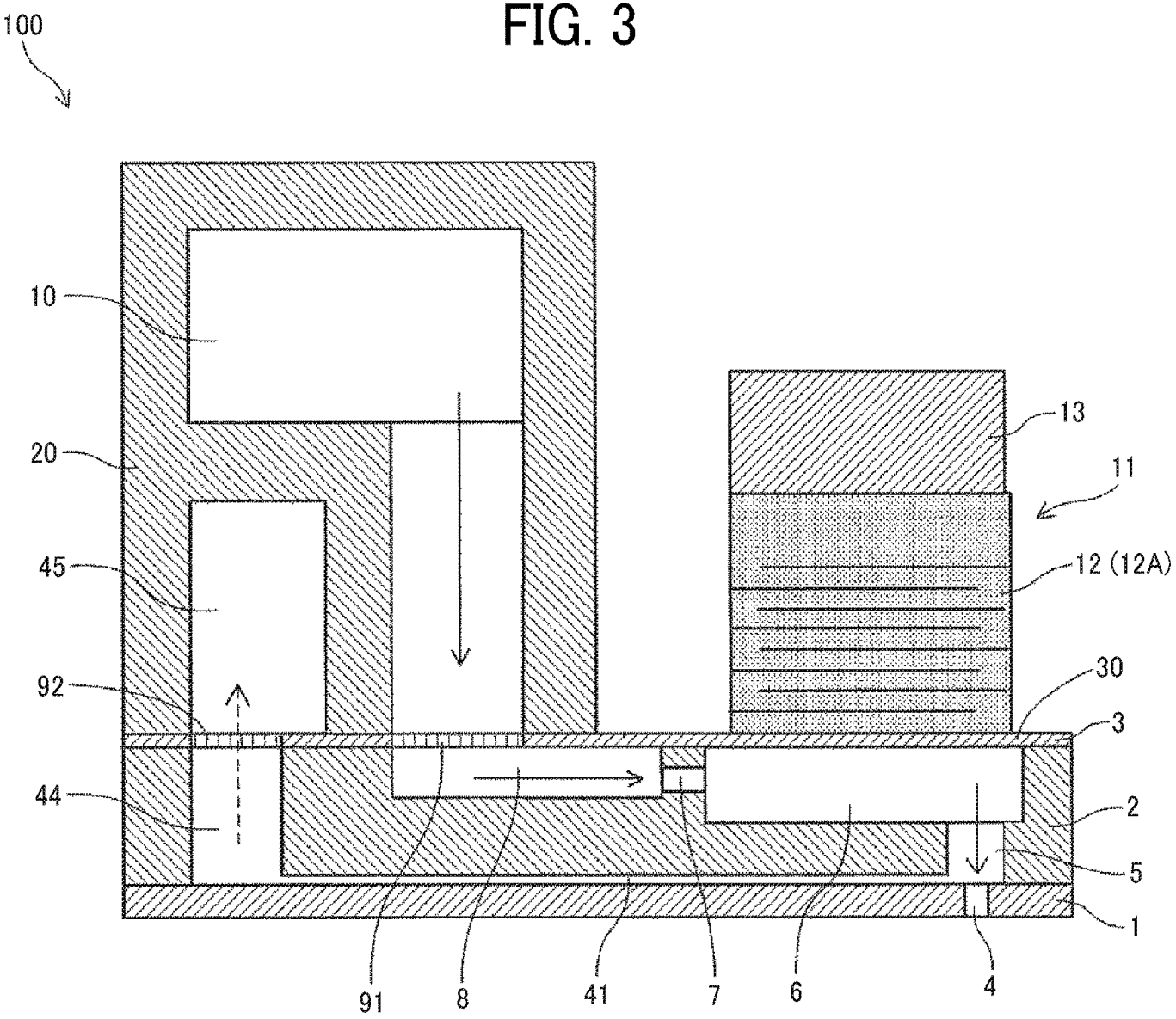
FIG. 3 is a cross-sectional view of a liquid discharge head in a direction (a longitudinal direction of an individual liquid chamber) perpendicular to a nozzle array direction in which nozzles are arrayed in row.
Figure 4:
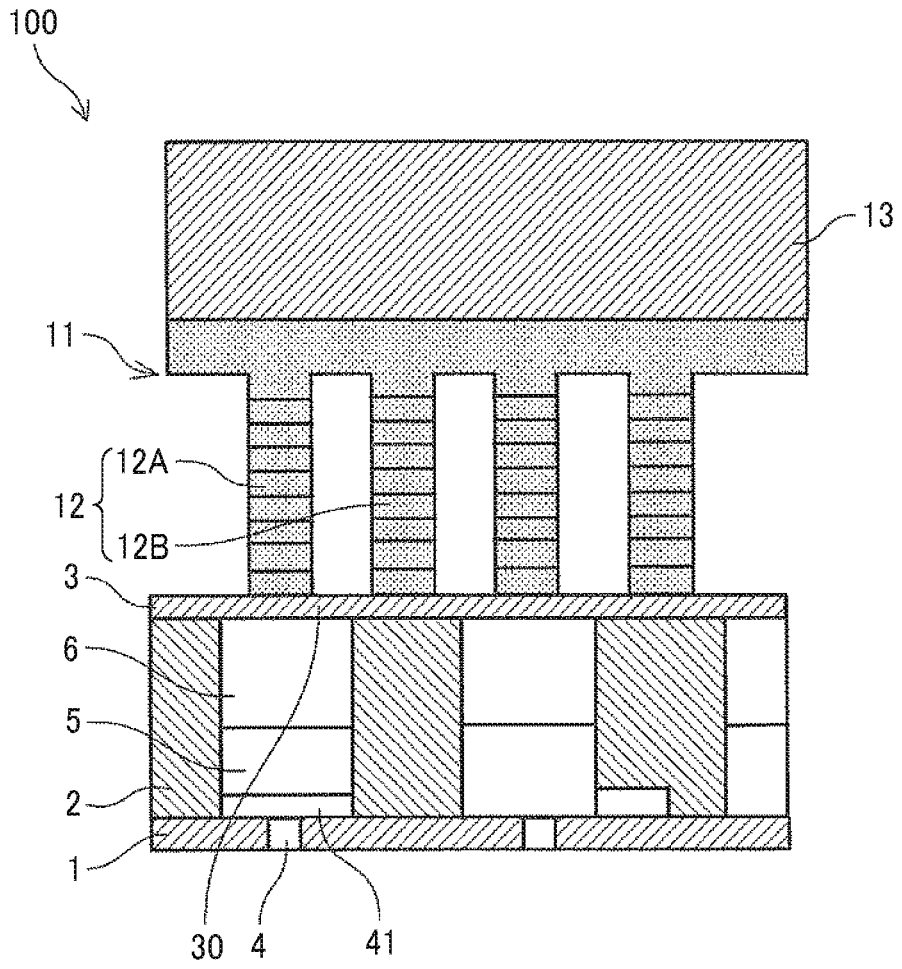
FIG. 4 is a cross-sectional view of the liquid discharge head illustrated in FIG. 3 cut along the nozzle array direction (a short-side direction of the individual liquid chamber)

A liquid discharge head according to an embodiment of the present disclosure is described with reference to FIGS. 3 and 4. FIG. 3 is a cross-sectional view of the liquid discharge head in the direction (the longitudinal direction of an individual liquid chamber) perpendicular to a nozzle array direction. FIG. 4 is a cross-sectional view of the liquid discharge head in the nozzle array direction (the short-side direction of the individual liquid chamber).

The liquid discharge head 100 illustrated in FIGS. 3 and 4 includes a nozzle plate 1, a channel substrate 2, and a diaphragm 3 as a wall member that are laminated one on another and bonded to each other. The liquid discharge head 100 includes piezoelectric actuators 11 to displace the diaphragm 3 and a common channel member 20 as a frame member.

The nozzle plate 1 includes a plurality of nozzles 4 to discharge liquid. In the present embodiment, the liquid discharge head 100 includes two nozzle arrays, each of which includes a plurality of nozzles 4, but FIG. 3 illustrates the nozzles 4 of one of the two nozzle arrays.

The channel substrate 2 defines through-holes and grooves that serve as individual liquid chambers 6 communicating with the nozzles 4 via nozzle communication channels 5, fluid restrictors 7 communicating with the individual liquid chambers 6, and liquid introduction portions 8 communicating with the fluid restrictors 7. The nozzle communication channel 5 is a flow channel continuous and communicating with the nozzle 4 and the individual liquid chamber 6. The fluid restrictors 7 and the liquid introduction portions 8 constitute a plurality of individual supply channels.

The diaphragm 3 includes deformable vibration portions 30 serving as wall faces of the individual liquid chambers 6 of the channel substrate 2.

The piezoelectric actuator 11 is disposed on a side of the diaphragm 3 opposite a side facing the individual liquid chambers 6. The piezoelectric actuator 11 includes electromechanical transducer elements as drivers (actuators or pressure generators) to deform the diaphragm 3.

The piezoelectric actuator 11 includes a plurality of piezoelectric elements 12A and 12B (also collectively "piezoelectric elements 12") bonded to a base 13. The piezoelectric elements 12A and 12B are pillar-shaped electromechanical transducer elements (piezoelectric pillars) arranged at regular intervals in the nozzle array direction. The piezoelectric elements 12A are bonded to the vibration portions 30.

The channel substrate 2 includes individual collecting channels 41, which respectively communicate with the individual liquid chambers 6 via the nozzle communication channels 5. Each individual collecting channel 41 includes a liquid exit portion 44 penetrating the channel substrate 2.

The common channel member 20 defines a common supply channel 10 and a common collecting channel 45. The common supply channel 10 communicates with the liquid introduction portion 8 via a supply-side filter 91 formed by the diaphragm 3. The common collecting channel 45 communicates with the liquid exit portion 44 via a recovery-side filter 92 formed by the diaphragm 3.

In the liquid discharge head 100, for example, when the voltage applied to the piezoelectric element 12A is lowered from a reference potential, the piezoelectric element 12A contracts. As a result, the vibration portion 30 of the diaphragm 3 is pulled and the volume of the individual liquid chambers 6 increases, thus causing the liquid to flow into the individual liquid chambers 6.

When the voltage applied to the piezoelectric element 12A is raised, the piezoelectric element 12A expands in the direction of lamination. Accordingly, the diaphragm 3 deforms in a direction toward the nozzle 4, and the volume of the individual liquid chamber 6 reduces. Thus, the liquid in the individual liquid chamber 6 is pressurized and discharged from the nozzle 4.

When the voltage applied to the piezoelectric element 12A is returned to the reference potential, the vibration portion 30 of the diaphragm 3 is returned to the initial position. Accordingly, the individual liquid chamber 6 expands to generate a negative pressure, thus replenishing the individual liquid chamber 6 with the liquid from the common supply channel 10 and the individual collecting channel 41. After the vibration of a meniscus surface of the nozzle 4 decays to a stable state, the liquid discharge head 100 shifts to the discharge of a next droplet.

The liquid that is not discharged from the nozzles 4 passes by the nozzles 4 and is collected in the common collecting channel 45 through the individual collecting channel 41, the liquid exit portion 44, and the recovery-side filter 92. Then, the liquid is again supplied from the common collecting channel 45 to the common supply channel 10 through an external circulation passage. Even when the liquid discharge is not performed, the liquid flows from the common supply channel 10 to the common collecting channel 45 and is again supplied to the common supply channel 10 through the external circulation passage.

Note that the driving method of the liquid discharge head 100 is not limited to the above-described example (pull-push discharge). For example, pull discharge or push discharge may be performed in response to the manner of application of the drive waveform.

Figure 5:
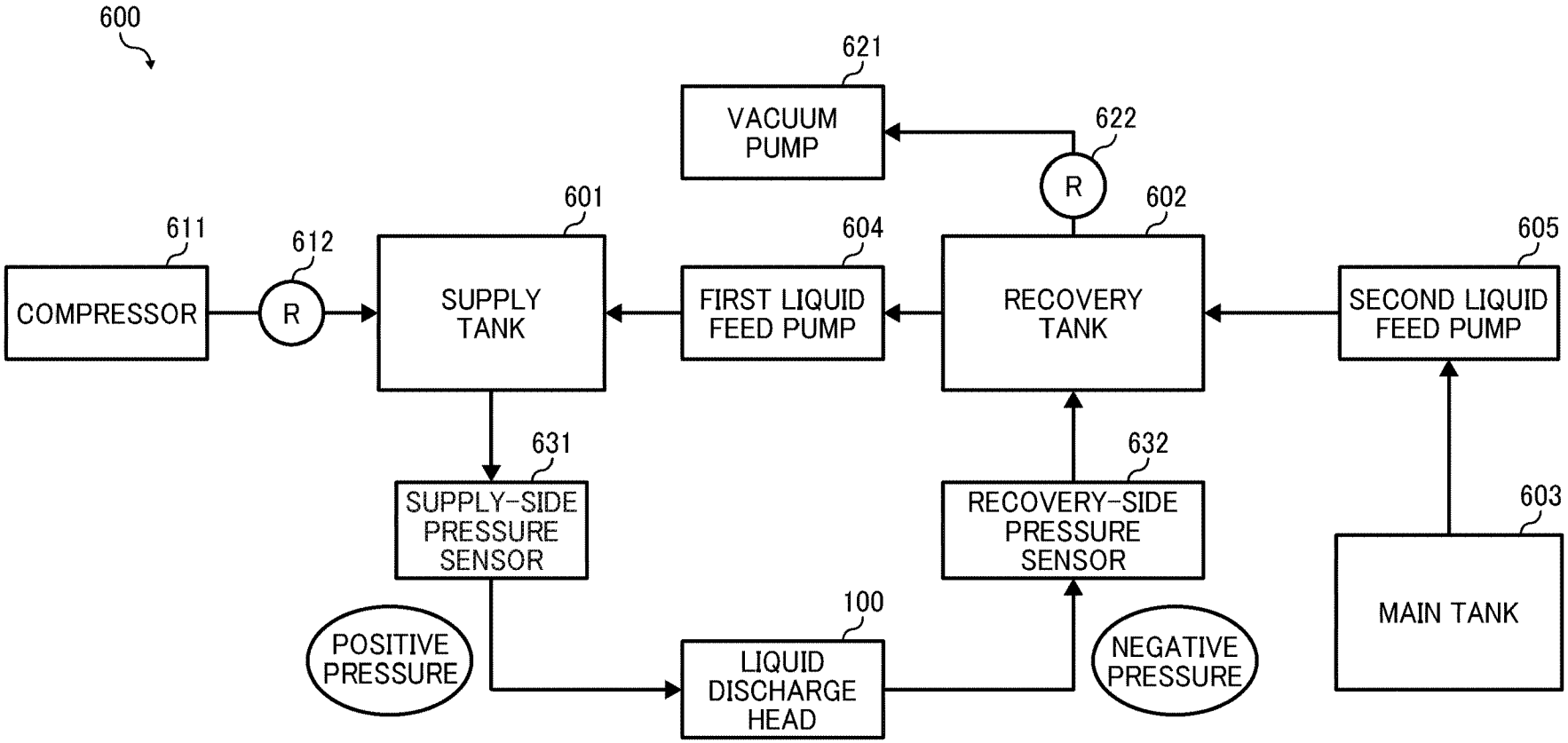
FIG. 5 is a block diagram illustrating an example structure for liquid circulation according to an embodiment.

Next, descriptions are given below of an example of a liquid circulation structure employed in the liquid discharge apparatus according to the present embodiment, with reference to FIG. 5. FIG. 5 is a block diagram illustrating the structure for liquid circulation. Although only one head is illustrated in FIG. 5, in the structure including a plurality of heads as illustrated in FIG. 2, supply-side liquid channels and recovery-side liquid channels are respectively coupled via manifolds or the like to the supply sides and recovery sides of the plurality of heads.

A liquid circulation structure 600 illustrated in FIG. 5 includes a supply tank 601, a recovery tank 602, a main tank 603, a first liquid feed pump 604, a second liquid feed pump 605, a compressor 611, a regulator 612, a vacuum pump 621, a regulator 622, a supply-side pressure sensor 631, a recovery-side pressure sensor 632, and the like.

The compressor 611 and the vacuum pump 621 together generate a pressure difference between the supply tank 601 and the recovery tank 602.

The supply-side pressure sensor 631 is disposed between the supply tank 601 and the liquid discharge head 100 and coupled to the supply-side liquid channel coupled to a supply port of the liquid discharge head 100. The recovery-side pressure sensor 632 is coupled to the recovery-side liquid channel that is positioned between the liquid discharge head 100 and the recovery tank 602 and coupled to a recovery port of the liquid discharge head 100.

One end of the recovery tank 602 is coupled to the supply tank 601 via the first liquid feed pump 604, and the other end of the recovery tank 602 is coupled to the main tank 603 via the second liquid feed pump 605.

Accordingly, the liquid flows from the supply tank 601 into the liquid discharge head 100 via the supply port and exits the liquid discharge head 100 from the recovery port into the recovery tank 602. Further, the first liquid feed pump 604 feeds the liquid from the recovery tank 602 to the supply tank 601. Thus, the liquid circulation channel is constructed.

The supply tank 601 is coupled to the compressor 611 and controlled to keep the pressure detected by the supply-side pressure sensor 631 at a predetermined positive pressure. The recovery tank 602 is coupled to the vacuum pump 621 and controlled to keep the pressure detected by the recovery-side pressure sensor 632 at a predetermined negative pressure.

Such a configuration allows the meniscus of liquid to maintain a constant negative pressure while circulating the liquid inside the liquid discharge head 100.

When the liquid is discharged from the nozzles 4 of the liquid discharge heads 100, the amount of liquid in each of the supply tank 601 and the recovery tank 602 decreases. Accordingly, the recovery tank 602 is replenished with the liquid fed from the main tank 603 by the second liquid feed pump 605.

The timing of supply of liquid from the main tank 603 to the recovery tank 602 can be controlled in accordance with a result of detection by a liquid level sensor in the recovery tank 602. For example, the liquid is supplied to the recovery tank 602 from the main tank 603 in response to a detection result that the liquid level in the recovery tank 602 is lower than a predetermined height.

A controller to control an entire operation of the printer 500 has a configuration similar to a general-purpose computer and includes, for example, a central processing unit (CPU), memories such as a read only memory (ROM) and a random access memory (RAM), and the like. The CPU performs various types of control processing by executing programs stored in the memory.

Figure 6:
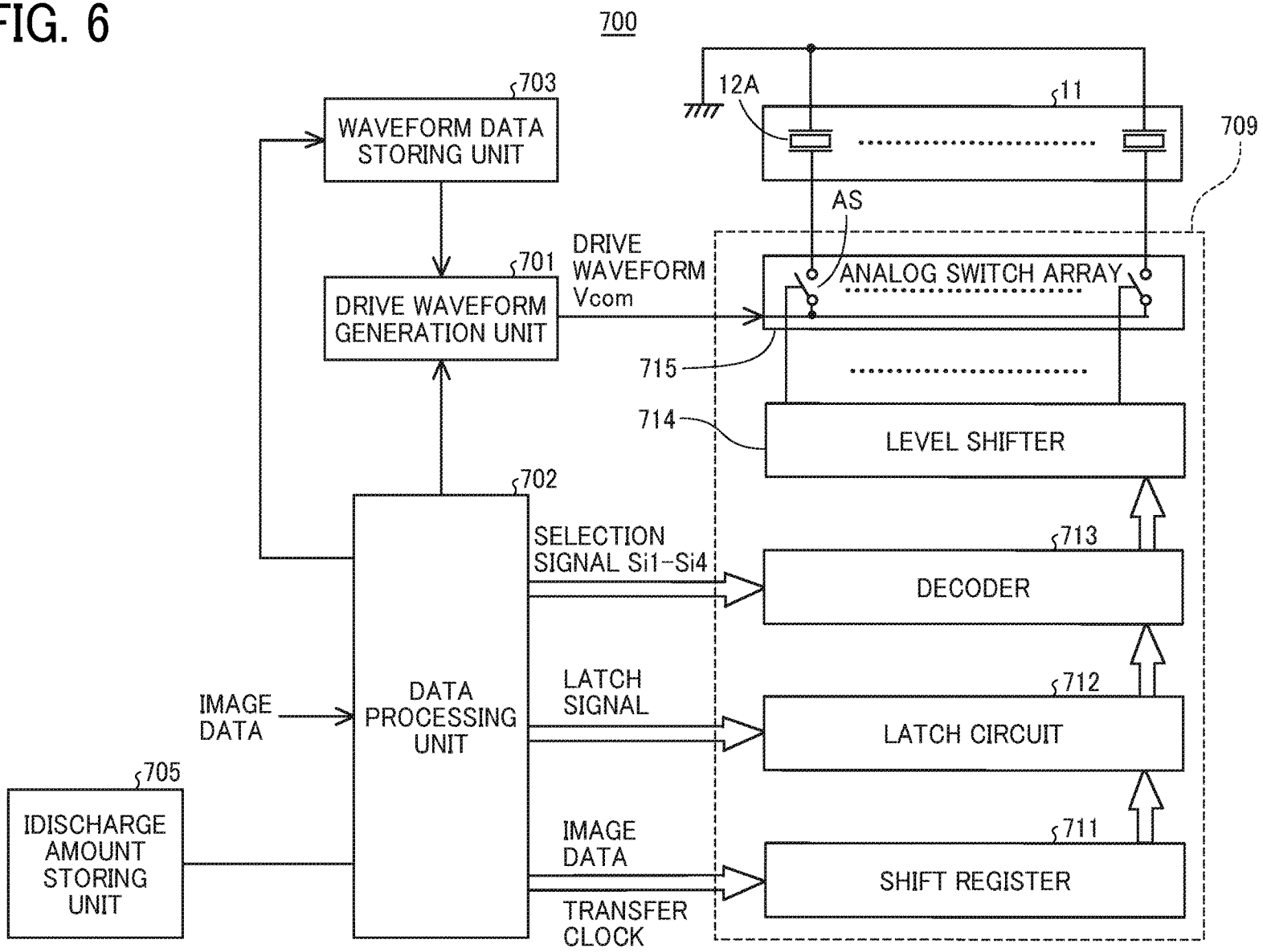
FIG. 6 is a block diagram illustrating an example of a head drive controller that drives and controls the liquid discharge head illustrated in FIG. 3.
Figure 7:
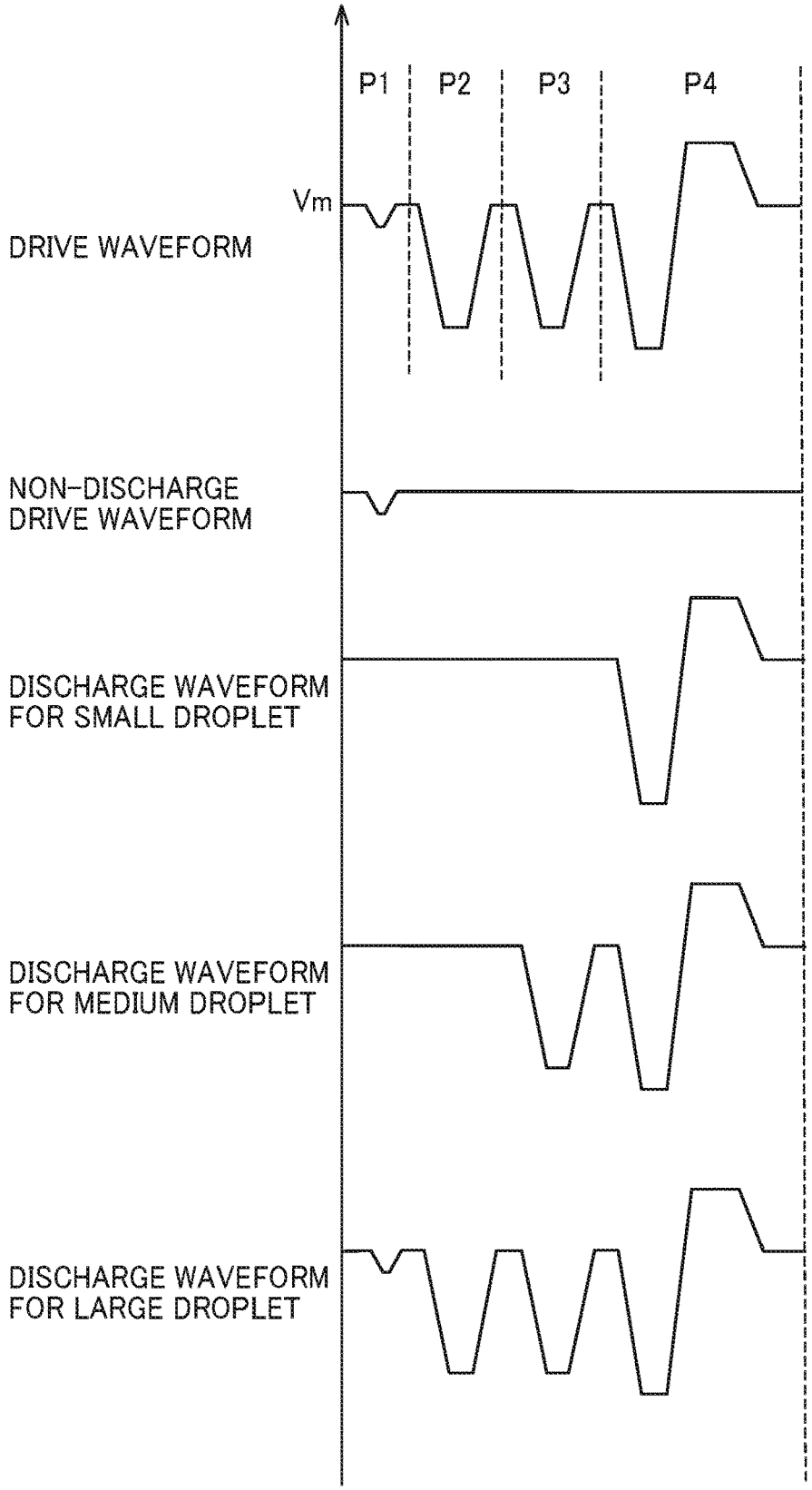
FIG. 7 is a graph illustrating an example of a drive waveform referred in explaining the head drive controller illustrated in FIG. 6.

Next, with reference to FIGS. 6 and 7, a description is given of an example head drive controller to control driving of the liquid discharge head. FIG. 6 is a block diagram illustrating a configuration of a head drive controller 700 according to the present embodiment, and FIG. 7 is a graph illustrating an example drive waveform.

The head drive controller 700 includes a drive waveform generation unit 701 (for example, implemented by a CPU executing a program), a data processing unit 702 (for example, implemented by the CPU executing a program), a waveform data storing unit 703, and a head driver 709.

The waveform data storing unit 703 is implemented by a read only memory (ROM) or the like and stores drive waveform data. The drive waveform generation unit 701 includes a digital-to-analog (D/A) conversion unit that performs digital to analog conversion of the drive waveform data read from the waveform data storing unit 703 and an amplification unit that performs current amplification and voltage amplification on the signal of the converted drive waveform. The drive waveform generation unit 701 generates and outputs a common drive waveform Vcom. The drive waveform generation unit 701 generates and outputs a drive waveform Vcom. The drive waveform Vcom includes one or a plurality of drive pulses (drive signals) for discharging liquid in one printing period (one drive period) is arranged in time sequence.

The data processing unit 702 outputs 2-bit image data (gradation signals of 0 and 1) corresponding to a print image, clock signals, latch signals, and selection signals Si1 to Si4 (droplet control signals) for selecting drive pulses of the drive waveform.

The drive waveform generation unit 701 generates and outputs the drive waveform Vcom in which one or a plurality of drive pulses (drive signals) for discharging liquid in one printing period (one drive period) is in time sequence.

The selection signals Si1 to Si4 instruct opening and closing of an analog switch AS for each droplet. The analog switch AS is a switch of the head driver 709. The state (level) of selection signals Si1 to Si4 transitions to a high (H) level (ON) for a drive pulse (or waveform element) to be selected and transitions to a low (L) level (OFF) when not selected, in accordance with a printing period (drive period) of a drive waveform PV.

The head driver 709 includes a shift register 711, a latch circuit 712, a decoder 713, a level shifter 714, and an analog switch array 715.

To the shift register 711, transfer clock (shift clock) and serial image data are input from the data processing unit 702. The serial image data is 2-bit gradation data per channel (one nozzle). The latch circuit 712 latches each value on the shift register 711 according to a latch signal.

The decoder 713 decodes the gradation data and the selection signals to output the result of decoding. The level shifter 714 converts the level of logic level voltage signals of the decoder 713 to a level at which the analog switch AS of the analog switch array 715 can operate.

The analog switch AS of the analog switch array 715 is turned on and off (opened and closed) corresponding to the output from the decoder 713 via the level shifter 714.

The analog switch AS of the analog switch array 715 is coupled to the individual electrode of the piezoelectric element 12A, and the drive waveform Vcom from the drive waveform generation unit 701 is input to the analog switch AS. Thus, the analog switch AS is turned on corresponding to the result generated by the decoder 713 decoding the serial-transfer image data (gradation data) and the selection signals. Thus, drive pulses (or waveform elements) constructing the drive waveform Vcom pass (are selected) to the individual electrode of the piezoelectric element 12A. The drive pulse is an example of predetermined drive signal.

For example, as illustrated in FIG. 7, the drive waveform Vcom includes four drive pulses (drive signals) P1, P2, P3, and P4 in time series. The drive pulse P1 is a micro vibrating pulse (a non-discharge pulse not for liquid discharge) that vibrates the meniscus to such an extent that no liquid is discharged. The drive pulses P2 to P4 are discharge pulses for discharging the liquid.

Then, the required one of the drive pulses P1 to P4 is selected with each of the selection signals Si1 to Si4. As a result, as the waveform to be applied to the piezoelectric element 12A of the liquid discharge head 100, a non-discharge drive waveform is formed with the non-discharge pulse P1, a drive waveform for discharging a small droplet is formed with the discharge pulse P4, a drive waveform for discharging a medium droplet is formed with the discharge pulses P3 and P4, and a drive waveform for discharging a large droplet is formed with the discharge pulses P2 to P4.

In this way, a plurality of drive signals is generated and output, and one or more of the drive signals are selected, thereby forming droplets of different sizes, such as small droplets, medium droplets, and large droplets. The discharge pulse P4 of the drive waveform Vcom is a drive signal (discharge pulse) commonly selected in forming droplets of any size.

Figure 8:
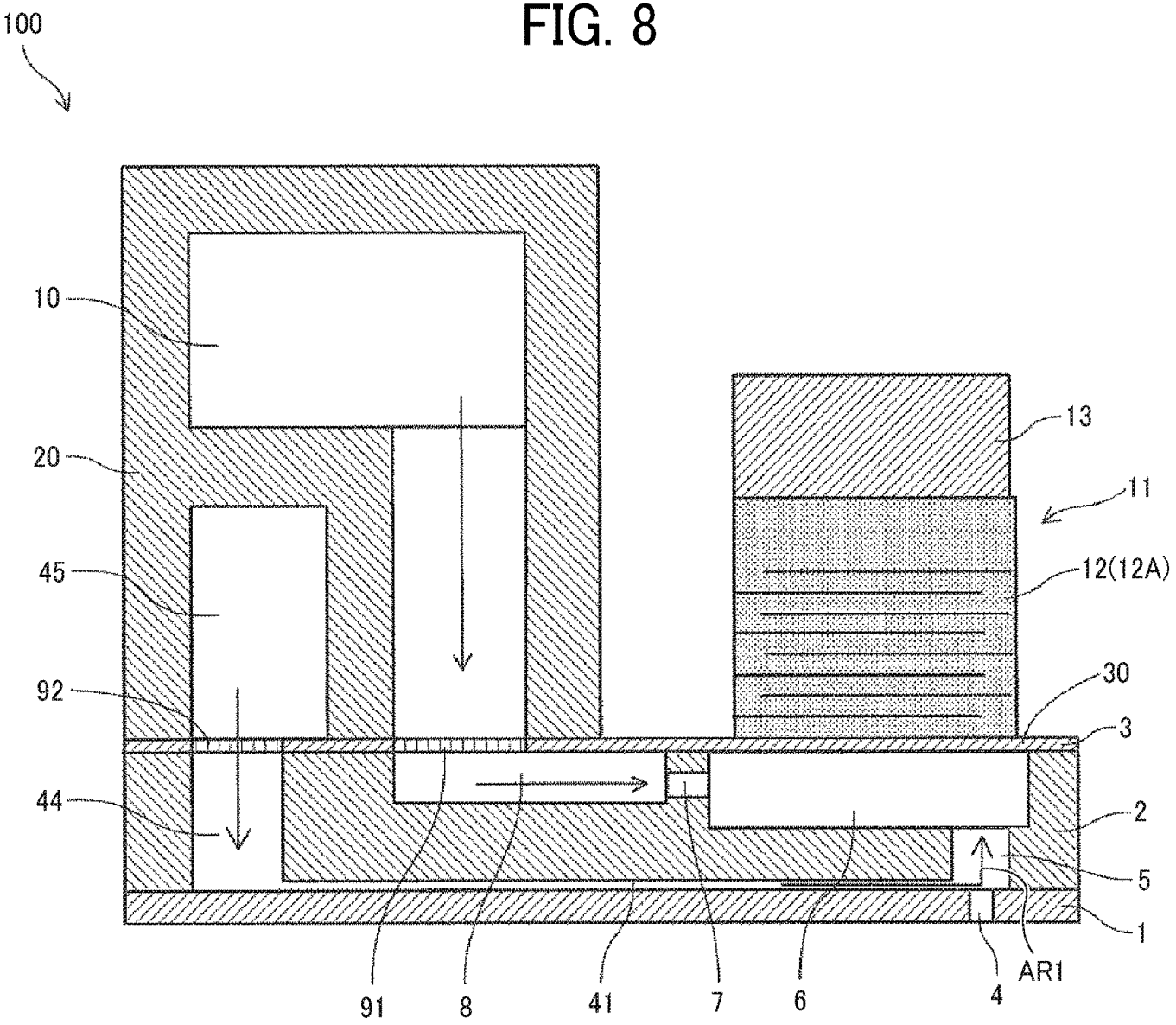
FIG. 8 is a cross-sectional view for explaining backflow of liquid when the liquid is discharged according to an embodiment.

Next, a feature of the present disclosure is described with reference to FIGS. 8 and 9. FIG. 8 is a cross-sectional view for explaining backflow in discharging liquid, and FIG. 9 is a table illustrating relations among the amount of discharge per unit time, the direction of flow of liquid, and bubble discharge performance.

As described above, when the liquid is not being discharged from the nozzle 4, as indicated by arrows in FIG. 3, the liquid flows from the common supply channel 10 to the individual liquid chamber 6, the individual collecting channel 41, and the common collecting channel 45 (a liquid recovery direction). Then, the liquid is recovered to the common supply channel 10 of the liquid discharge head 100 via the external liquid circulation structure 600.

After discharging the liquid from the nozzle 4, as the voltage applied to the piezoelectric element 12A is returned to the reference potential (Vm in FIG. 7), the vibration portion 30 of the diaphragm 3 is restored to the initial position. Accordingly, the individual liquid chamber 6 expands to generate a negative pressure, thus refilling the individual liquid chamber 6 with the liquid.

At this time, when the amount of liquid supplied from the common supply channel 10 is not sufficient to compensate for the amount of liquid discharged from the nozzle 4, as indicated by arrow AR1 in FIG. 8, the liquid is supplied also from the individual collecting channel 41 to the individual liquid chamber 6. That is, the setting of discharge amount and the configuration of channels make the liquid to flow in a reverse direction from the individual collecting channel 41 toward the individual liquid chamber 6, in the refilling after the discharging of liquid.

The backflow of the liquid can peel off air bubbles adhering to the wall surface of the individual collecting channel 41 and the recovery-side filter 92. Thus, bubble discharge performance is improved.

The discharge amount at which the backflow occurs (hereinafter "backflow-inducing discharge amount) is determined in advance in an experiment, for each of different amounts of liquid supplied to the individual liquid chamber 6. The backflow-inducing discharge amount, obtained based on the experiment, is stored in a memory. The data processing unit 702 outputs a signal to set the discharge amount greater than the backflow-inducing discharge amount stored in the memory, when the backflow is desired. For example, a discharge amount storing unit 705 (see FIG. 6), implemented by the ROM or the like, stores the backflow-inducing discharge amount for each supply amount.

FIG. 9 illustrates an example of the flow rate (supply flow rate) in the individual supply channel, the flow rate (recovery flow rate) in the individual collecting channel 41, and the number of times of drive up to bubble discharge, under each discharge condition. Note that, when the flow rate is a negative value in FIG. 9, the liquid is in backflow.

Referring to FIG. 9, the discharge amount per unit time (per minute) can be understood as a multiplication of discharge droplet amount with drive frequency for liquid discharge. As can be known from FIG. 9, as the discharge amount per unit time increases, the flow rate of backflow increases, and the number of times of drive up to bubble discharge decreases. Thus, bubble discharge is facilitated.

Further, when the amount of liquid supplied from the individual liquid chamber 6 to the nozzle 4 is set smaller relative to the amount of droplets discharged from the nozzle 4 (discharge droplet amount), the backflow of liquid from the individual collecting channel 41 to the nozzle 4 can be caused even at the discharge of droplets from the nozzle 4.

Such backflow can also peel off air bubbles adhering to the wall surface of the individual collecting channel 41 and the recovery-side filter 92, thereby facilitating bubble discharge.

Note that it is unnecessary to cause the backflow of liquid from the individual collecting channel 41 each time the liquid is discharged or the individual liquid chamber 6 is refilled. Alternatively, for example, in the configuration capable of discharging a plurality of different size droplets as described above, the discharge amount is set and the channels are configured to cause the backflow at the time of discharging or refilling only when the large droplets are discharged.

Although the description above concerns a structure including a plurality of nozzles, a plurality of individual chambers, and a plurality of individual channels respectively communicating with the plurality of individual chambers, aspects of this disclosure can adapt to a structure including one nozzle, one individual chamber, and one individual channel.

In the present embodiment, the liquid discharged is not limited to a particular liquid as long as the liquid has a viscosity or surface tension to be discharged from a head (liquid discharge head). However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment liquid, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs an electrothermal transducer element, such as a heat element, and an electrostatic actuator including a diaphragm and opposed electrodes.

Examples of the liquid discharge apparatus include, not only apparatuses capable of discharging liquid to materials to which liquid can adhere, but also apparatuses to discharge a liquid toward gas or into a liquid.

The liquid discharge apparatus may include at least one of devices for feeding, conveying, and discharging the material to which liquid can adhere. The liquid discharge apparatus may further include at least one of a pretreatment apparatus and a post-processing apparatus.

As the liquid discharge apparatuses, for example, there are image forming apparatuses to discharge ink onto sheets to form images and three-dimensional fabricating apparatuses to discharge molding liquid to a powder layer in which powder is molded into a layer-like shape, so as to form three-dimensional fabricated objects.

The "liquid discharge apparatus" is not limited to an apparatus to discharge liquid to visualize meaningful images, such as letters or figures. For example, the liquid discharge apparatus may be an apparatus to form meaningless images, such as meaningless patterns, or fabricate meaningless three-dimensional images.

The above-mentioned term "material to which liquid can adhere" represents a material which liquid can, at least temporarily, adhere to and solidify thereon, or a material into which liquid permeates. Examples of "material to which liquid can adhere" include paper sheets, recording media such as recording sheet, recording sheets, film, and cloth; electronic components such as electronic substrates and piezoelectric elements; and media such as powder layers, organ models, and testing cells. The term "material to which liquid can adhere" includes any material to which liquid adheres, unless particularly limited.

The above-mentioned "material to which liquid adheres" may be any material, such as paper, thread, fiber, cloth, leather, metal, plastic, glass, wood, ceramics, or the like, as long as liquid can temporarily adhere.

The "liquid discharge apparatus" may be an apparatus in which the liquid discharge head and a material to which liquid can adhere move relatively to each other. However, the liquid discharge apparatus is not limited to such an apparatus. For example, the liquid discharge apparatus may be a serial head apparatus that moves the liquid discharge head or a line head apparatus that does not move the liquid discharge head.

Examples of the "liquid discharge apparatus" further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

The terms "image formation", "recording", "printing", "image printing", and "fabricating" used herein may be used synonymously with each other.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid discharge apparatus comprising:

a liquid discharge head including:

a nozzle plate including at least one nozzle configured to discharge liquid;

at least one individual liquid chamber communicating with the at least one nozzle, respectively;

at least one individual supply channel communicating with the at least one individual liquid chamber, respectively; and at least one individual collecting channel communicating with the at least one individual liquid chamber, respectively; and circuitry configured to:

store, in a memory, a backflow-inducing discharge amount at which the liquid in the individual collecting channel flows in a reverse direction toward the corresponding individual liquid chamber, in response to discharge of the liquid from the corresponding nozzle; and set a discharge amount from the nozzle equal to or greater than the backflow-inducing discharge amount, to cause the liquid to flow in the reverse direction in the corresponding individual collecting channel.

2. The liquid discharge apparatus according to claim 1, wherein the liquid discharge head further includes a filter disposed downstream from the individual collecting channel in a liquid recovery direction in which the liquid flows from the individual liquid chamber to the corresponding individual collecting channel.

* * * * *